US011296450B2

(12) United States Patent
Little

(10) Patent No.: US 11,296,450 B2
(45) Date of Patent: Apr. 5, 2022

(54) ELECTRICAL CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Terrance F. Little, Fullerton, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/939,334

(22) Filed: Jul. 27, 2020

(65) Prior Publication Data

US 2021/0028572 A1 Jan. 28, 2021

Related U.S. Application Data

(60) Provisional application No. 62/878,700, filed on Jul. 25, 2019.

(51) Int. Cl.

| | |
|---|---|
| ***H01R 13/40*** | (2006.01) |
| ***H01R 13/428*** | (2006.01) |
| ***H01R 13/502*** | (2006.01) |
| ***H01R 24/00*** | (2011.01) |
| ***H01R 12/71*** | (2011.01) |
| ***H01R 13/24*** | (2006.01) |
| ***H01R 12/57*** | (2011.01) |
| ***H01R 13/627*** | (2006.01) |

(52) U.S. Cl.

CPC ..... *H01R 13/428* (2013.01); *H01R 12/57* (2013.01); *H01R 12/71* (2013.01); *H01R 13/24* (2013.01); *H01R 13/502* (2013.01); *H01R 13/6271* (2013.01); *H01R 24/00* (2013.01)

(58) Field of Classification Search

CPC .. H01R 13/428; H01R 13/424; H01R 13/422; H01R 13/42; H01R 13/40; H01R 12/57; H01R 12/50; H01R 13/502; H01R 13/50; H01R 13/46; H01R 13/6271; H01R 13/62; H01R 24/00

USPC ..... 439/747, 660, 620.13, 620.15, 620.21, 439/620.22, 620.24

See application file for complete search history.

(56) References Cited

U.S. PATENT DOCUMENTS 5,587,884 A * 12/1996 Raman ..... H01R 13/665 333/182
7,281,938 B1 * 10/2007 Wu ..... H01R 13/6275 439/353
7,797,851 B2 * 9/2010 Funabashi ..... G01B 5/012 33/561

(Continued)

*Primary Examiner* — Harshad C Patel
(74) *Attorney, Agent, or Firm* — Ming Chieh Chang; Wei Te Chung

(57) ABSTRACT

An electrical connector assembly includes a receptacle connector and a plug connector adapted to be mated with each other. The receptacle connector includes a contact unit forwardly assembled into the receptacle housing and having a plurality of receptacle contacts and a common mode choke electrically connected together. The plug connector includes a resilient latch associated with the plug shell and received within an enlarged area of a circumferential space formed between the receptacle shell and the receptacle housing.

13 Claims, 19 Drawing Sheets

(56) References Cited

U.S. PATENT DOCUMENTS

| | | | | |
|---|---|---|---|---|
| 7,959,473 | B2 * | 6/2011 | Machado | H01R 13/514 439/676 |
| 8,206,183 | B2 * | 6/2012 | Machado | H01R 13/518 439/676 |
| 8,439,708 | B2 * | 5/2013 | Colantuono | H01R 13/6582 439/660 |
| 8,480,440 | B2 * | 7/2013 | Machado | H01R 13/719 439/676 |
| 8,684,769 | B2 * | 4/2014 | Kao | H01R 13/6585 439/607.28 |
| 8,968,033 | B2 * | 3/2015 | Little | H01R 13/6581 439/660 |
| 9,281,625 | B2 * | 3/2016 | Kao | H01R 13/658 |
| 9,343,850 | B2 * | 5/2016 | Colahan | H01R 31/065 |
| 9,350,126 | B2 * | 5/2016 | Little | H01R 13/6591 |
| 9,490,579 | B2 * | 11/2016 | Little | H01R 13/642 |
| 9,490,584 | B2 * | 11/2016 | Little | H01R 13/748 |
| 9,496,664 | B2 * | 11/2016 | Little | H01R 12/724 |
| 9,608,391 | B2 * | 3/2017 | Little | H01R 12/724 |
| 10,164,362 | B2 * | 12/2018 | Little | H01R 24/00 |
| 10,720,734 | B2 * | 7/2020 | Little | H01R 13/6587 |
| 2008/0305680 | A1 * | 12/2008 | Little | H01R 24/64 439/541.5 |
| 2014/0113481 | A1 * | 4/2014 | Little | H01R 13/64 439/374 |
| 2015/0171573 | A1 * | 6/2015 | Little | H01R 13/6658 439/607.34 |
| 2015/0194772 | A1 * | 7/2015 | Little | H01R 13/6582 439/357 |
| 2017/0054258 | A1 * | 2/2017 | Little | H01R 24/60 |
| 2017/0207589 | A1 * | 7/2017 | Wu | H01R 13/6591 |
| 2018/0331468 | A1 * | 11/2018 | Little | H01R 12/724 |

* cited by examiner

ELECTRICAL CONNECTOR ASSEMBLY

CROSS REFERENCE TO RELATED APPLICATIONS

This application claims the benefit of, and priority to, U.S. Provisional Patent Application No. 62/878,700 filed Jul. 25, 2019, the contents of which are incorporated entirely herein by reference.

BACKGROUND OF THE INVENTION

1. Field of the Invention

The invention relates to the electrical connector assembly, and particularly to the plug connector and the receptacle connector adapted to be mated with each other in a releasable locking manner.

2. Description of Related Art

The automotive Ethernet connector may require to fit for multi-gig rate for 2.5 Gbs, 5 Gbs and 10 Gbs. A reliable connector assembly including the mated receptacle connector and plug connector, is desired.

SUMMARY OF THE INVENTION

An electrical connector assembly includes the receptacle connector and the plug connector adapted to be mated with each other. The receptacle connector for mounting upon an external printed circuit board, includes an insulative receptacle housing having a base and a mating tongue forwardly extending from the base with a pair of passageways and corresponding mating holes. A receptacle contact unit includes an internal printed circuit board secured inside the mating tongue, a pair of receptacle contacts and a common mode choke both soldered upon the internal printed circuit board. Each receptacle contact has a front mating section received within the corresponding passageway, and a rear mounting section extending downwardly beyond the internal printed circuit board and through the external printed circuit board. A metallic receptacle shell encloses the receptacle housing with a circumferential space formed between the receptacle housing and the receptacle shell with an enlarged locking area thereof. The plug connector includes an insulative plug housing and a pair of plug contacts retained in the plug housing. A cable includes a pair of wires connected to the corresponding plug contacts, respectively. Each plug contact has a front mating portion extending forwardly out of the plug housing for mating with the front mating section of the corresponding receptacle contact, and a rear mounting section mechanically and electrically connected to the corresponding wire. A metallic plug shell encloses the plug housing and having a front part to form a front receiving cavity in which the front mating portions of the plug contacts are disposed. A resilient latch unitarily extends from a front edge of the plug shell in a folded manner. During mating, the mating tongue of the receptacle connector is received within the receiving cavity of the plug connector, the plug contacts extend through the mating holes into the corresponding passageways to be mated with the corresponding receptacle contacts, respectively, and the plug shell is received within the circumferential space with the resilient latch disposed in the enlarged locking area.

Other objects, advantages and novel features of the invention will become more apparent from the following detailed description when taken in conjunction with the accompanying drawings.

DETAILED DESCRIPTION OF THE PREFERRED EMBODIMENT

Figure 1:
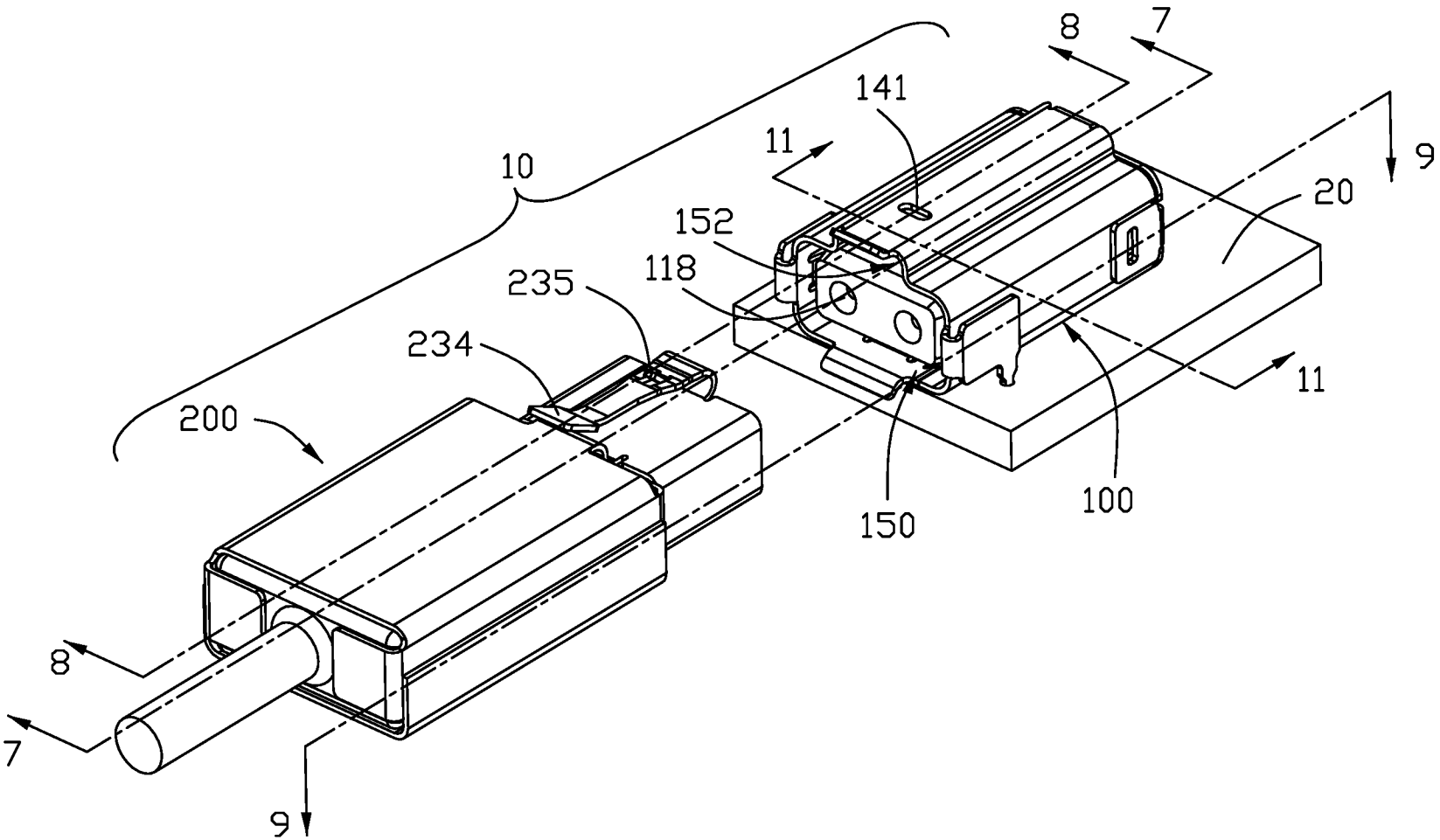
FIG. 1 is a perspective view of an electrical connector assembly according to the invention wherein the plug connector and the receptacle connector are separated from each other.
Figure 2:
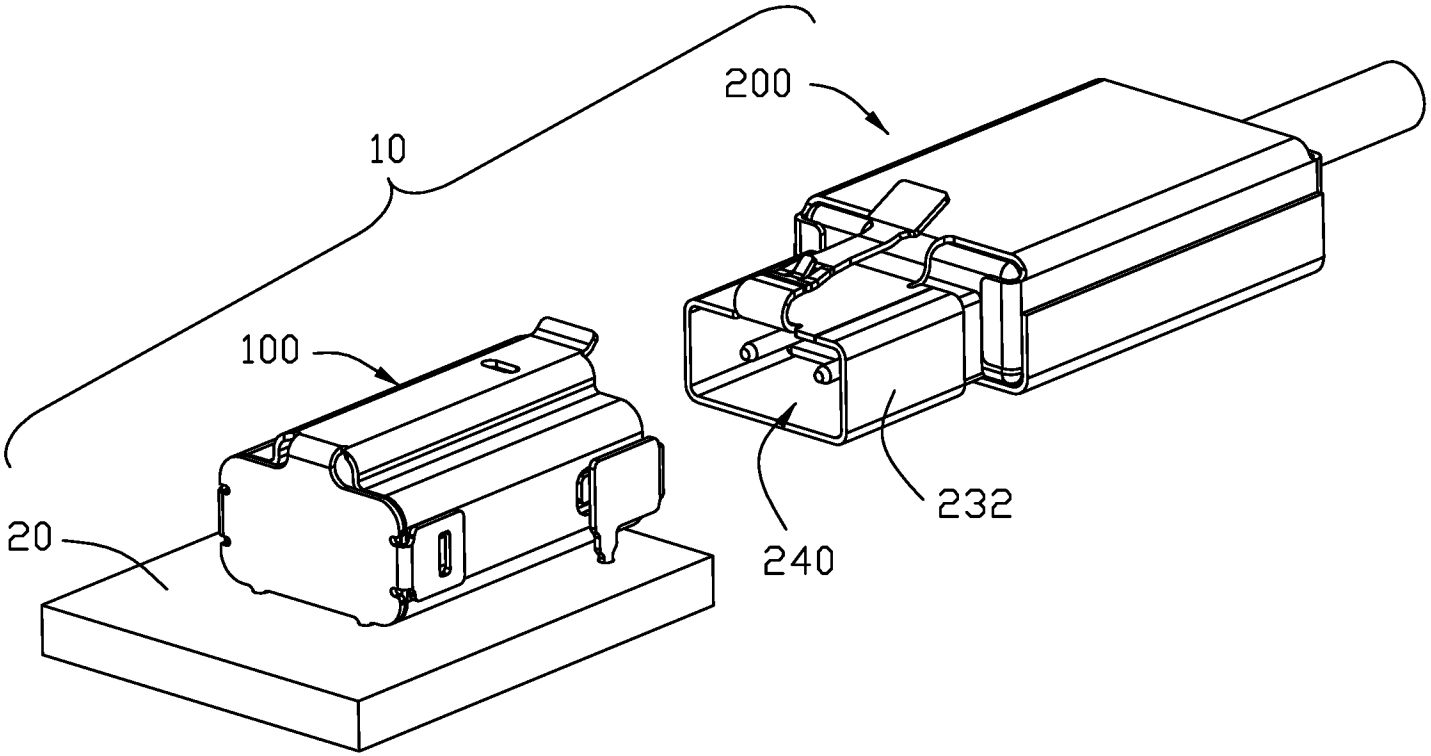
FIG. 2 is another perspective view of the electrical connector assembly of FIG. 1.
Figure 3:
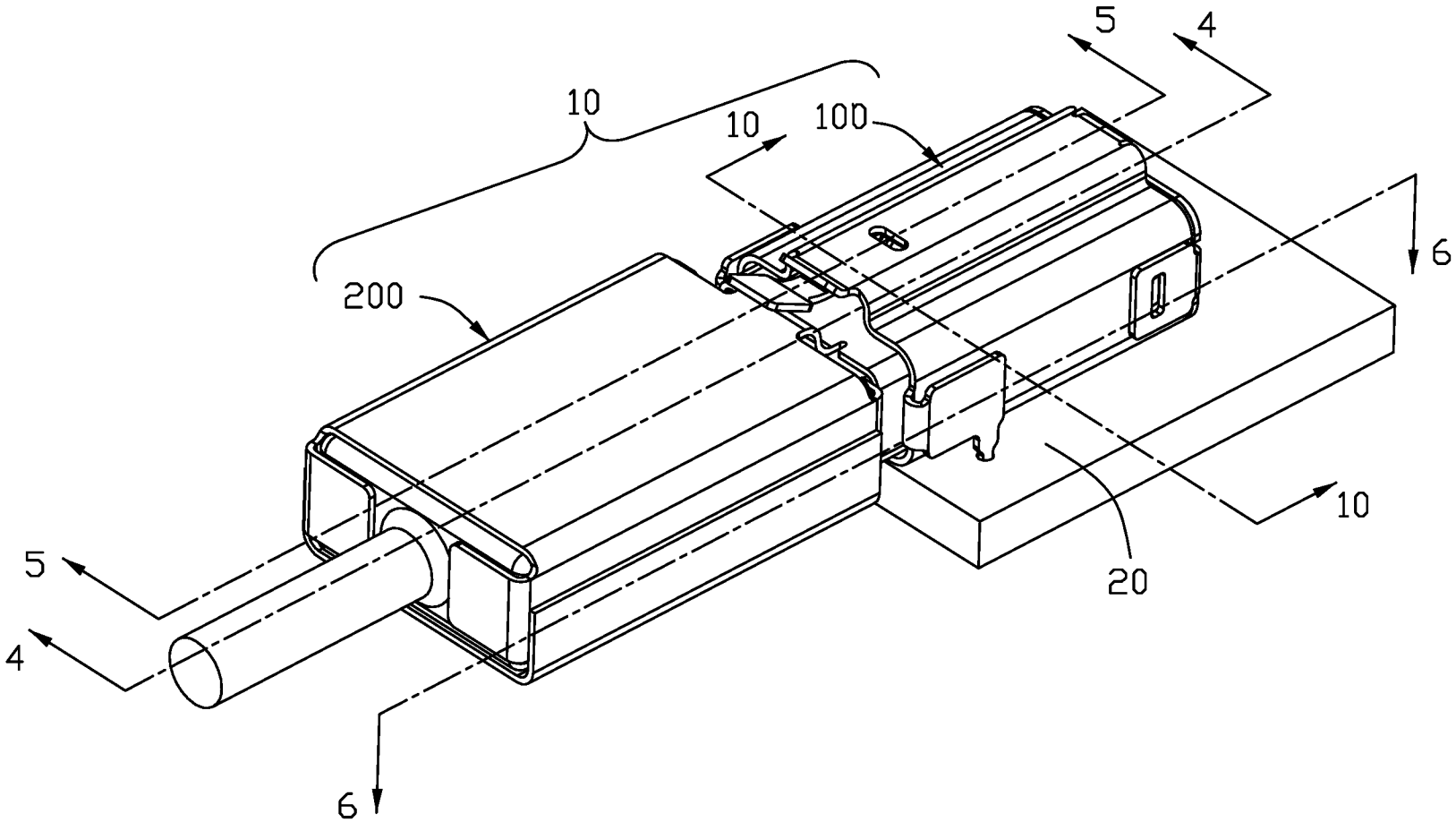
FIG. 3 is a perspective view of the electrical connector assembly of FIG. 1 wherein the plug connector and the receptacle connector are mated with each other.
Figure 4:
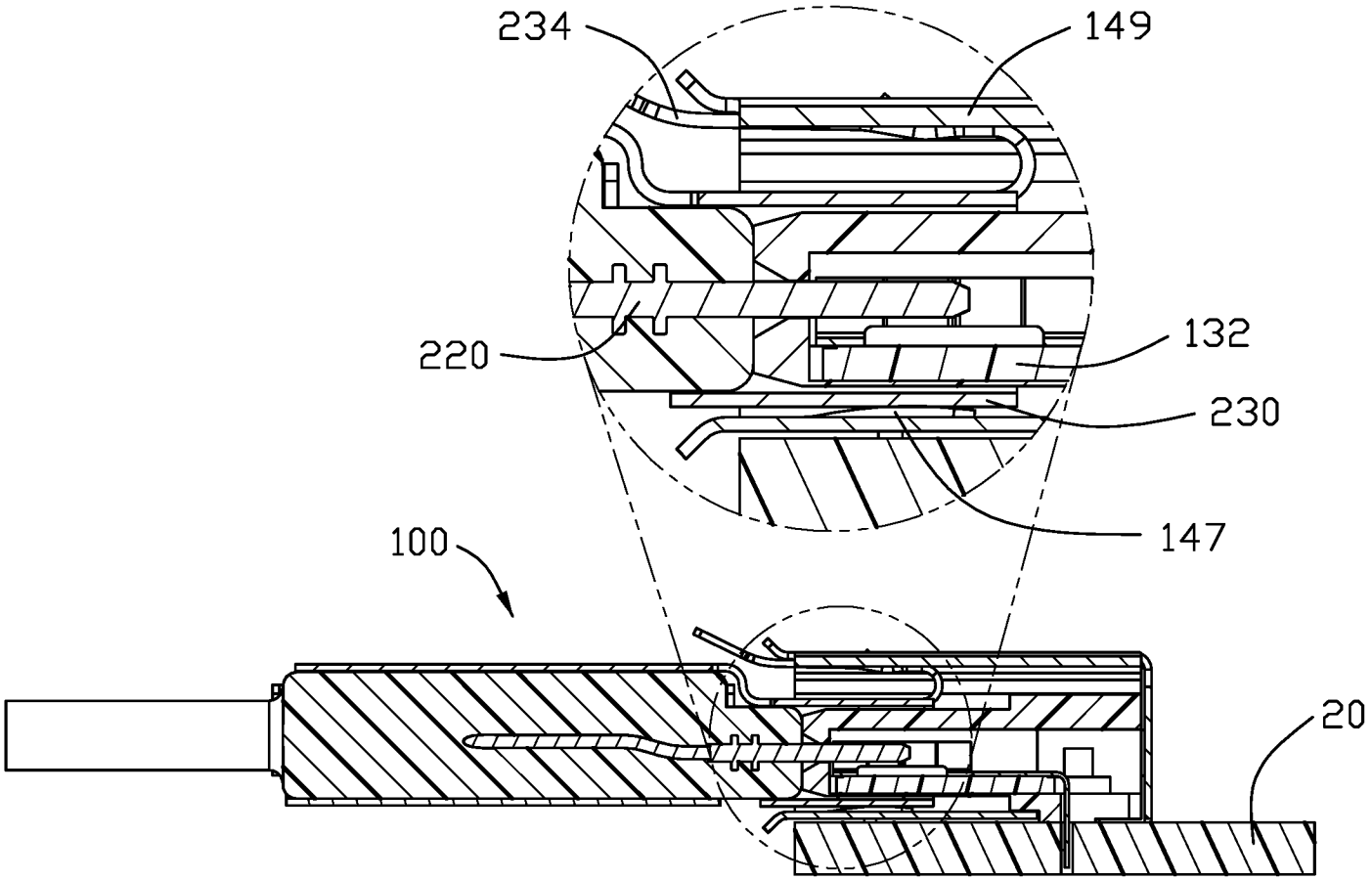
FIG. 4 is a cross-sectional view of the electrical connector assembly of FIG. 3 taken along lines 4-4.
Figure 5:
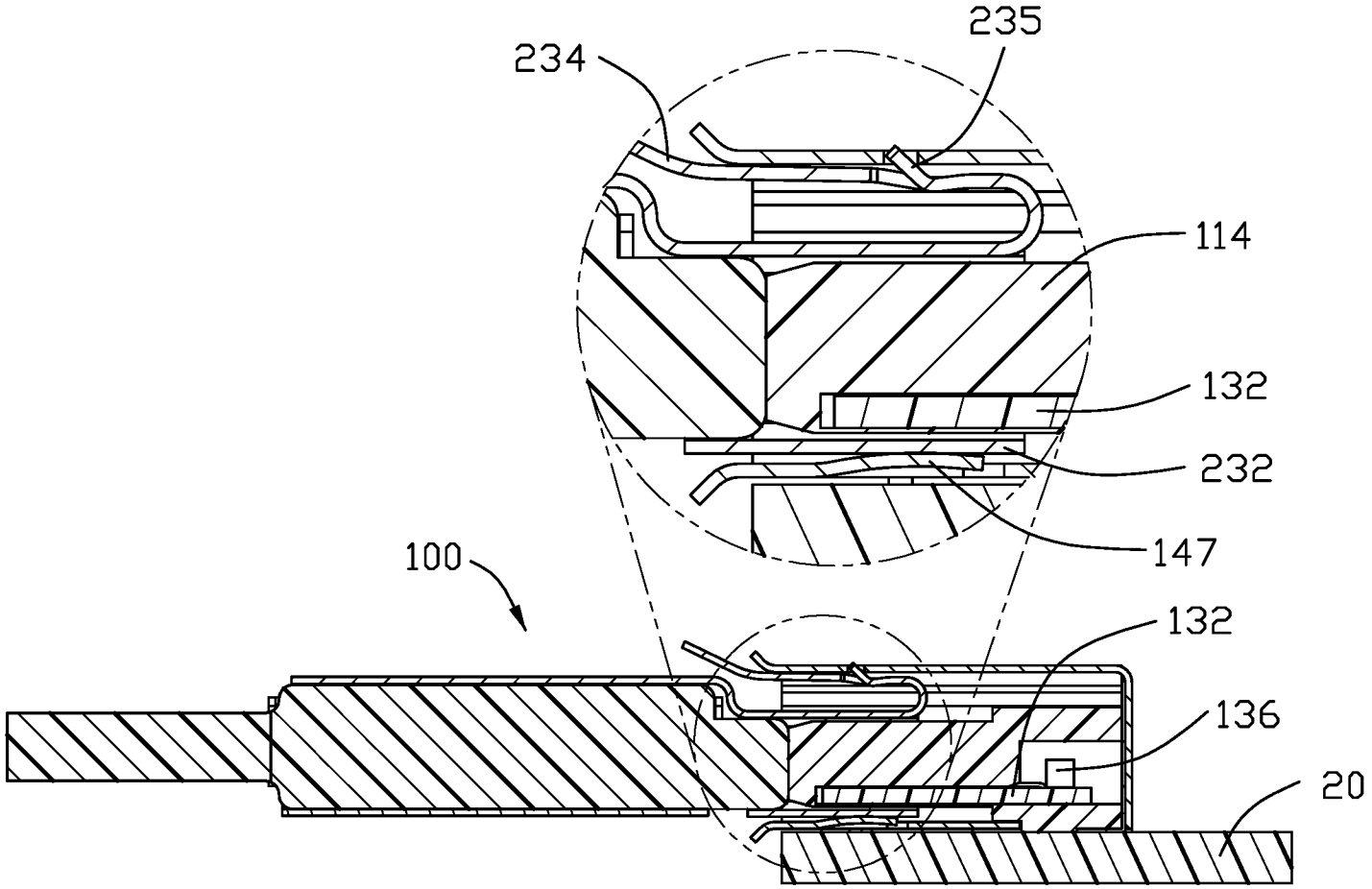
FIG. 5 is a cross-sectional view of the electrical connector assembly of FIG. 3 taken along lines 5-5.
Figure 6:
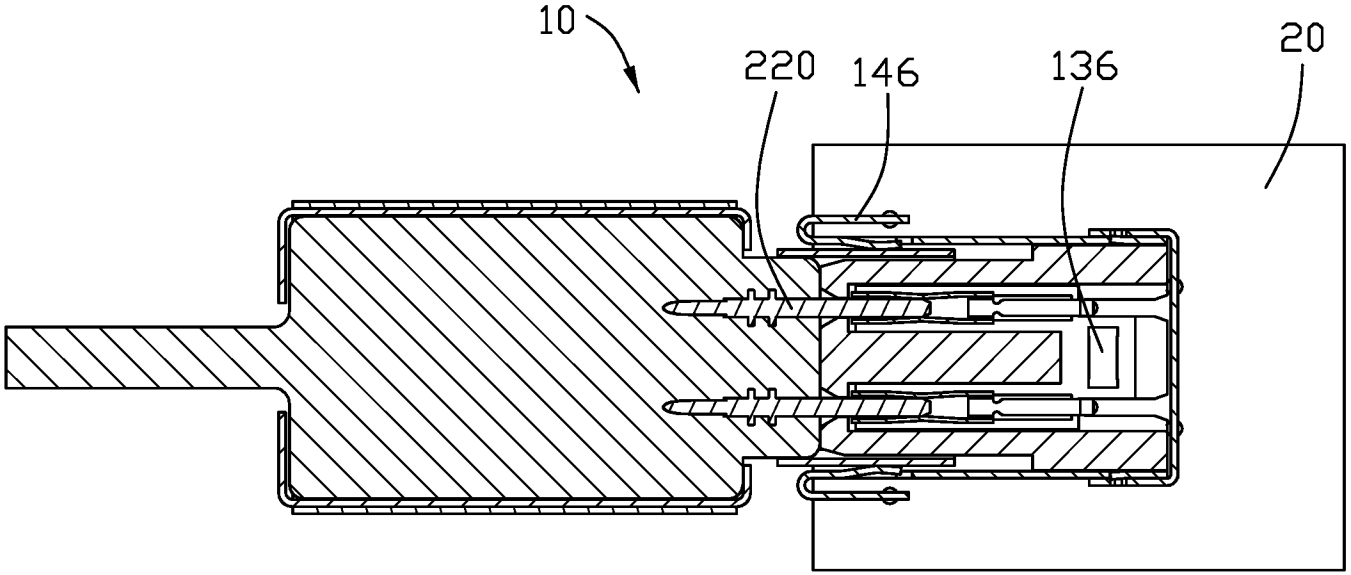
FIG. 6 is a cross-sectional view of the electrical connector assembly of FIG. 3 taken along lines 6-6.
Figure 7:
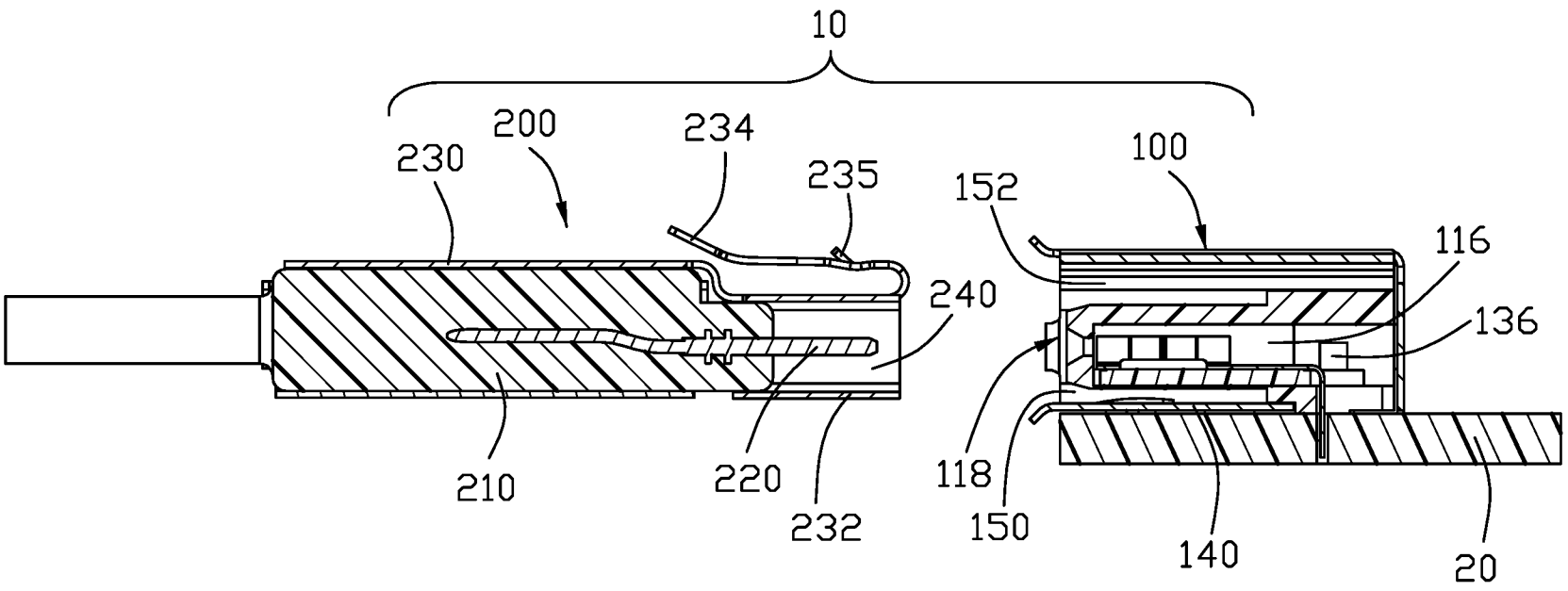
FIG. 7 is a cross-sectional view of the electrical connector assembly of FIG. 1 taken along lines 7-7.

Referring to FIGS. 1-17, an electrical connector assembly 10 includes the receptacle connector 100 and plug connector 200. The receptacle connector 100 for mounting upon an external printed circuit board 20, includes an insulative receptacle housing 110 having a base 112 and a mating tongue 114 forwardly extending from the base 112 with a pair of passageways 116 and corresponding mating holes 118 therein. A receptacle contact unit 130 includes an internal printed circuit board 132 secured inside the mating tongue 114, a pair of receptacle contacts 134 and a common mode choke 136 for filtering noises both commonly soldered upon the internal printed circuit board 132. Each receptacle contact 134 has a front mating section 135 received within the corresponding passageway 116, and a rear mounting section 137 extending downwardly beyond the internal printed circuit board 132 and through the positioning groove 115 of the base 114 and further into the corresponding hole in the external printed circuit board 20. A metallic receptacle shell 140 encloses the receptacle housing 110 with a circumferential space 150 formed between the receptacle housing 110 and the receptacle shell 140 and further with an enlarged locking area 152 or locking groover thereof due to a raised portion 149 of the receptacle shell 140.

Correspondingly, the plug connector 200 includes an insulative plug housing 210 and a pair of plug contacts 220 retained in the plug housing 210. A cable 241 includes a pair of wires 242 connected to the corresponding plug contacts 220, respectively. Each plug contact 220 has a front mating portion 221 extending forwardly out of the plug housing 210 for mating with the front mating section 135 of the corresponding receptacle contact 134, and a rear mounting section 223 mechanically and electrically connected to the corresponding wire 232. A metallic plug shell 230 encloses the plug housing 210 and having a front part 232 to form a front receiving cavity 240 in which the front mating portions 221 of the plug contacts 220 are disposed. A resilient latch 234 is disposed on the plug shell 23 in a folded manner, in this embodiment, the resilient latch 234 unitarily extends rearwards from a front edge of a top wall 2321 of a front portion 232 of the plug shell 230. An insulative overmolding may be applied upon the plug shell 230 to complete the structure.

During mating along the front-to-back direction, the mating tongue 114 of the receptacle connector 100 is received within the receiving cavity 240 of the plug connector 200, the front end face of the plug housing 230 abuts against the front end face of the mating tongue 114 of the receptacle housing 110, the plug contacts 220 extend through the mating holes 118 into the corresponding passageways 116 to be mated with the corresponding receptacle contacts 134, respectively, and the plug shell 230 is received within the circumferential space 150 with the resilient latch 234 disposed in the enlarged locking area 152 wherein the plug shell 230 and the receptacle shell 140 are mechanically and electrically connected to each other.

Figure 11:
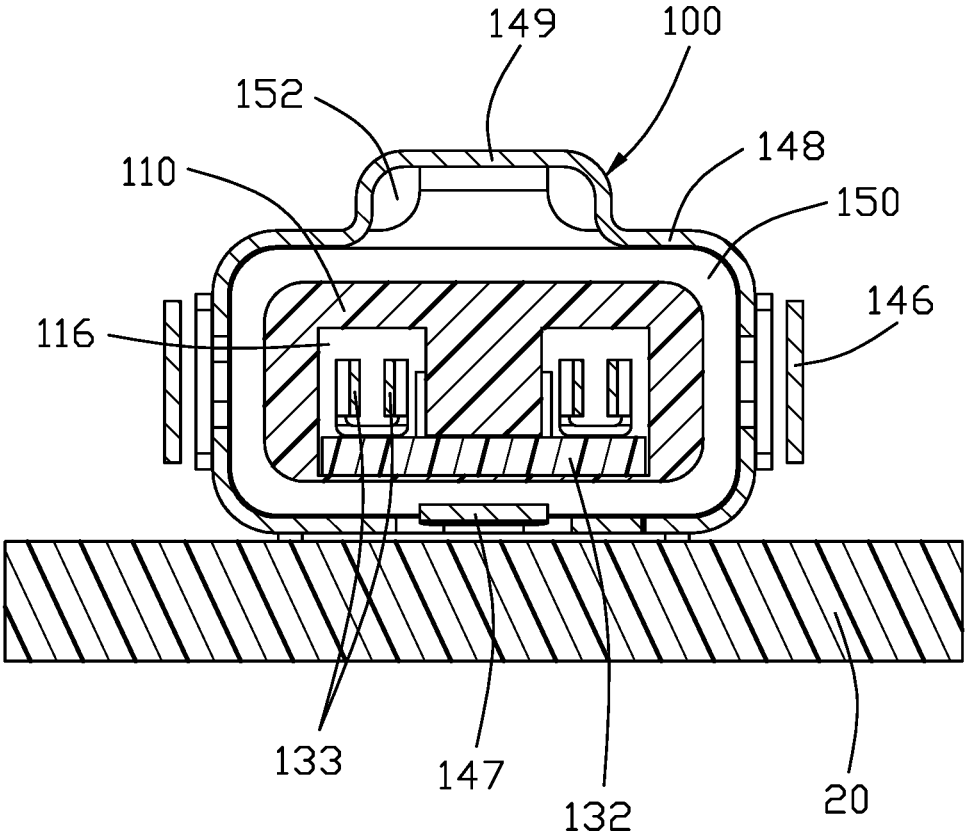
FIG. 11 is a cross-sectional view of the receptacle connector of the electrical connector assembly of FIG. 1 taken along lines 11-11.
Figure 12:
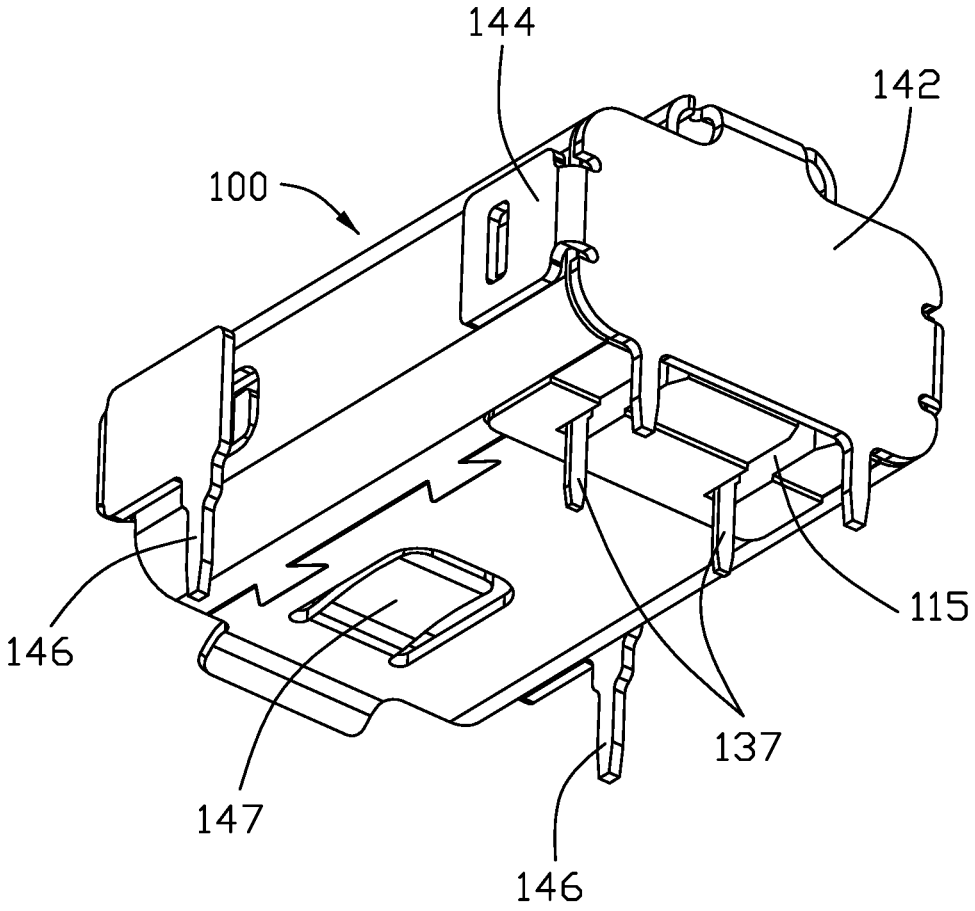
FIG. 12 is a perspective view of the receptacle connector of the electrical connector assembly of FIG. 1.
Figure 13:
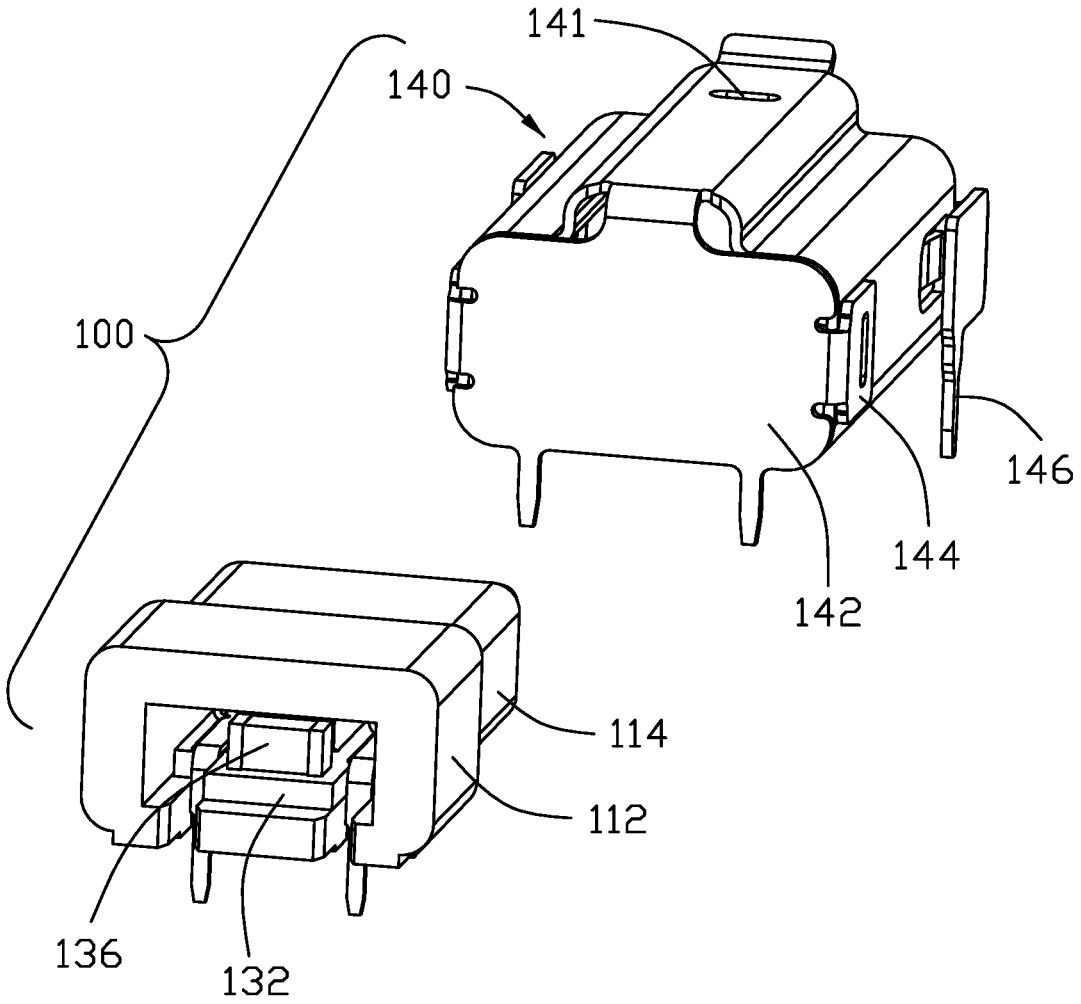
FIG. 13 is an exploded perspective view of the receptacle connector of FIG. 12 wherein the rear plate of the receptacle shell is bent to its final position.
Figure 14:
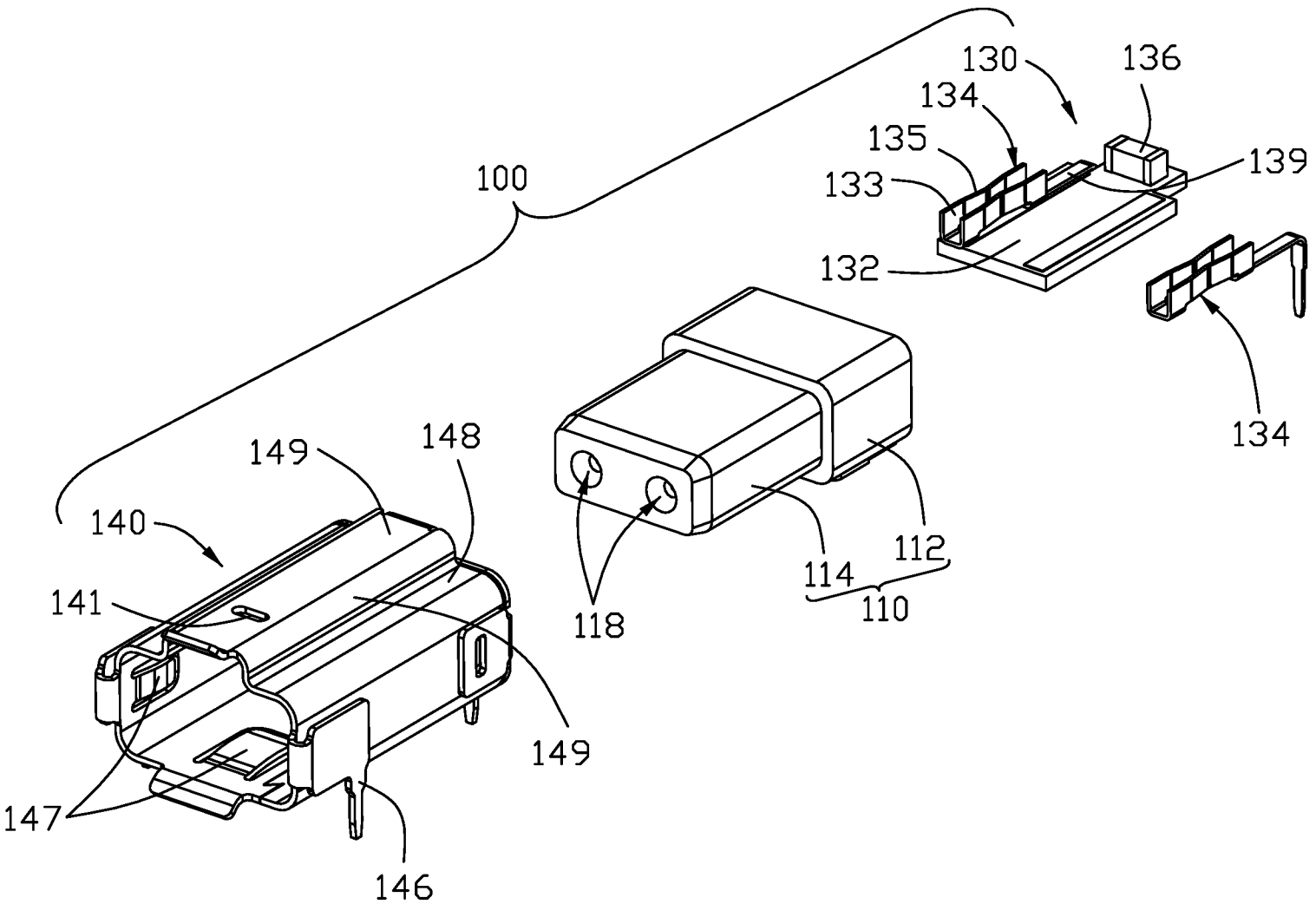
FIG. 14 is a further exploded perspective view of the receptacle connector of FIG. 13.
Figure 15:
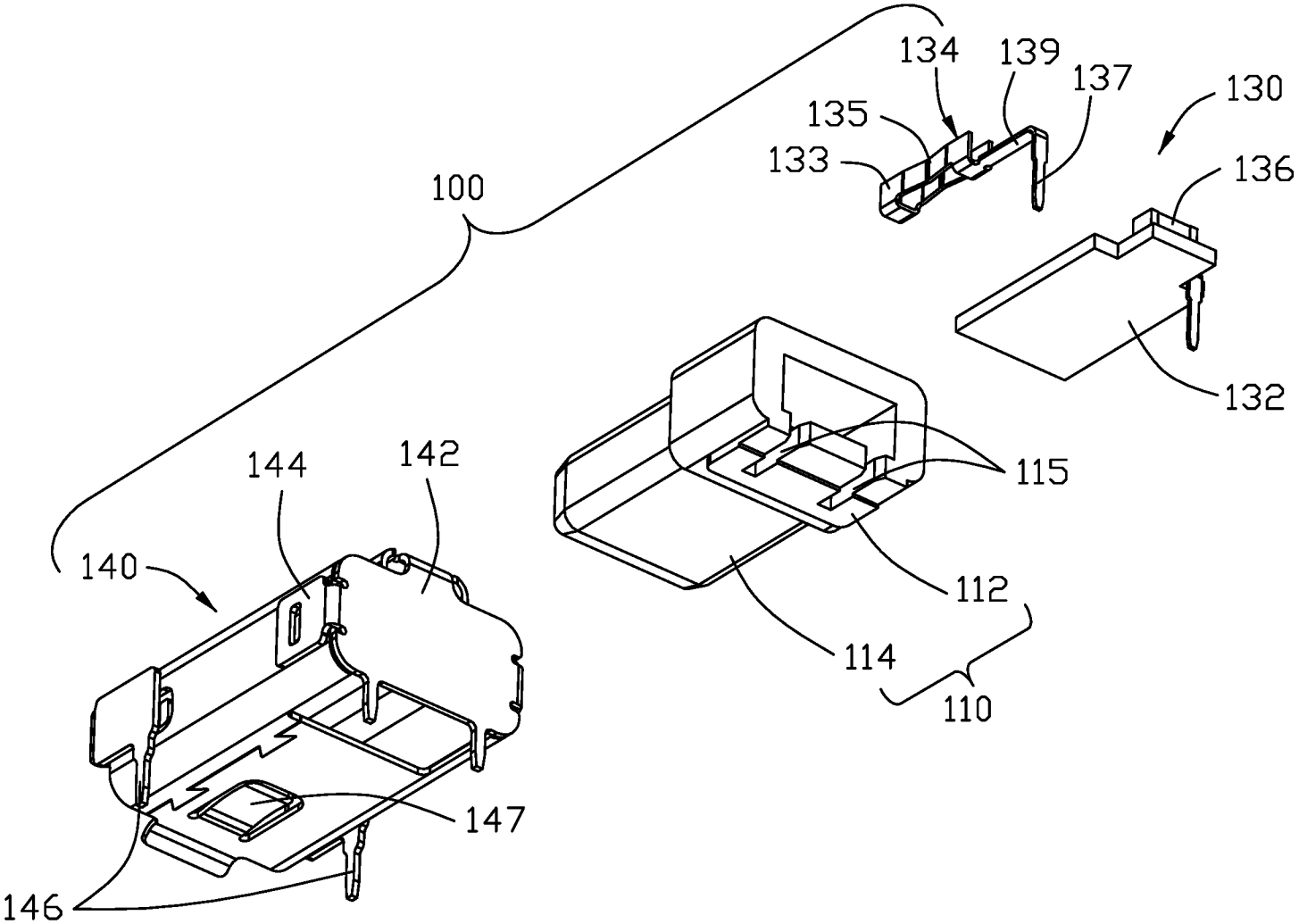
FIG. 15 is an another exploded perspective view of the receptacle connector of FIG. 14.
Figure 16:
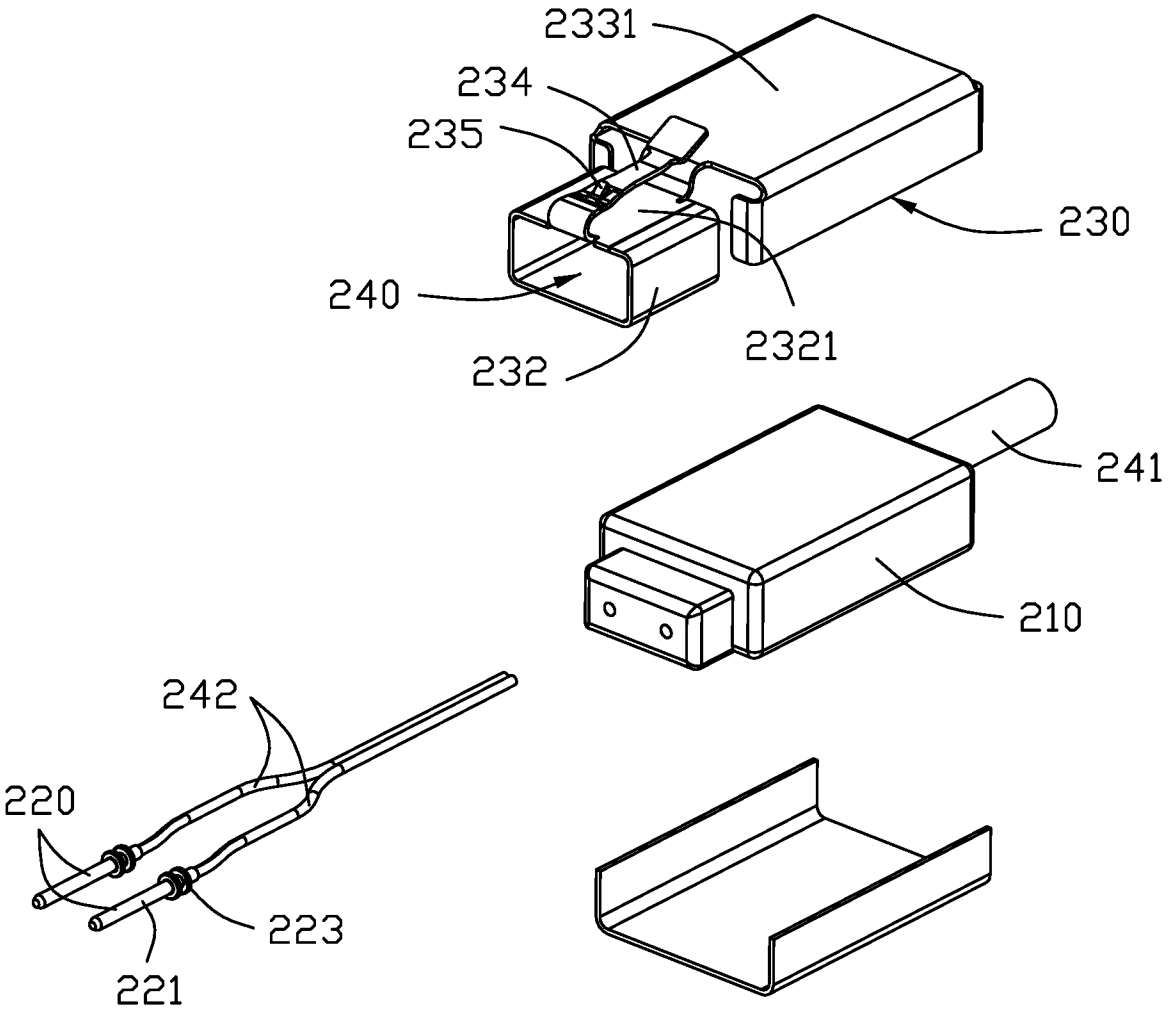
FIG. 16 is an exploded perspective view of the plug connector of the electrical connector assembly of FIG. 1.
Figure 17:
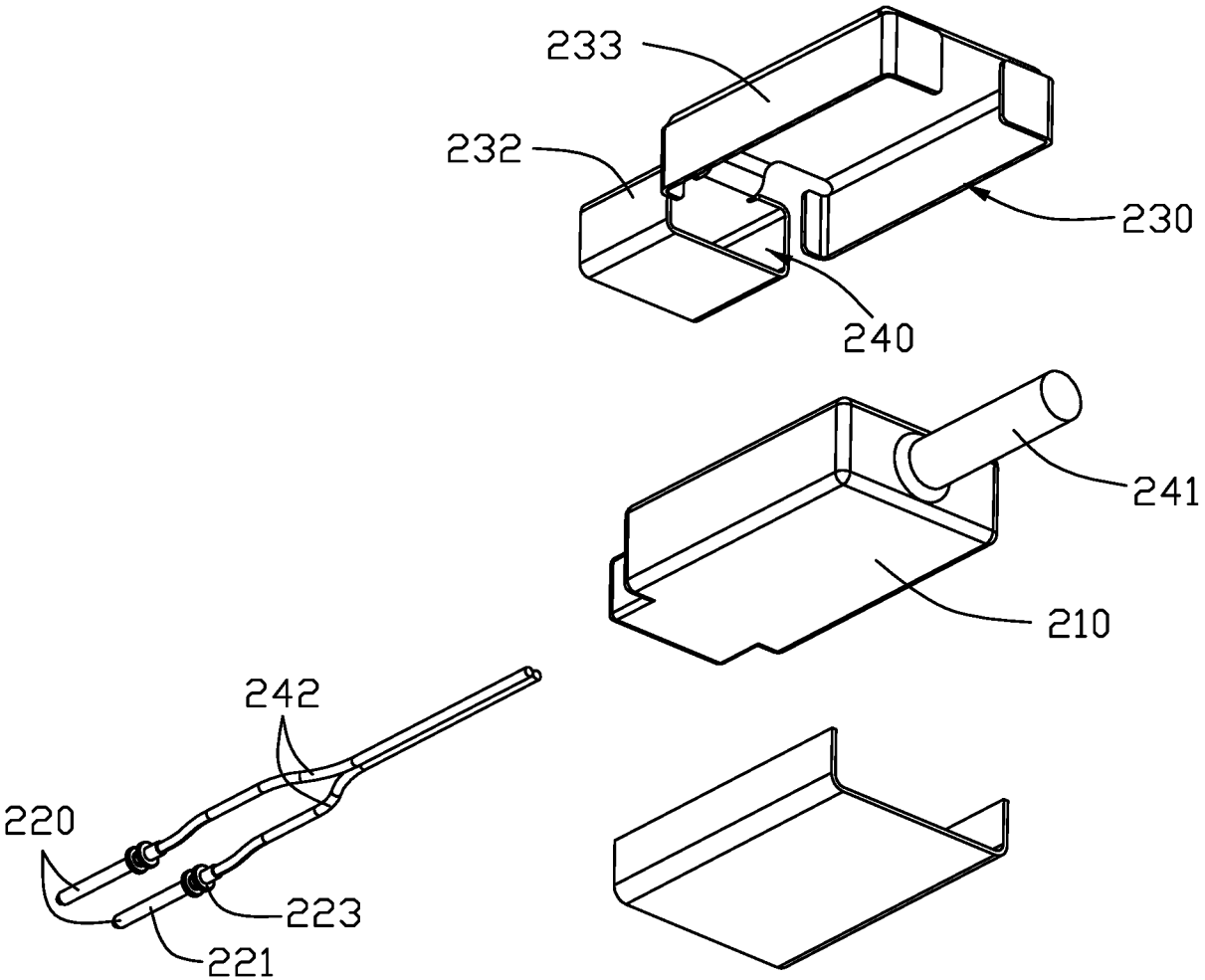
FIG. 17 is another exploded perspective view of the plug connector of FIG. 16.

The receptacle contact 134 has a retaining section 139 located between the mating section 135 and the mounting section 137 and soldered upon the printed circuit board 132 and electrically connected to the common mode choke 136. As shown in FIG. 11, in this embodiment, the printed circuit board 132 is hidden within the mating tongue 114 in both the horizontal direction and the vertical direction. In an alternate embodiment, the printed circuit board 132 may be downwardly exposed to an exterior. In the cross-sectional view, each passageway 116 has three sides formed by the receptacle housing 110 and one side formed by the printed circuit board 132. In this embodiment, the receptacle housing 110 is forwardly inserted into the receptacle shell 140 from a rear side thereof when the rear plate 142 of the receptacle shell 140 is not bent to its final vertical position. Once the receptacle housing 110 is assembled into the receptacle housing 110, the rear plate 142 of the receptacle shell 140 is bent to its final vertical position with a pair of locking ears 144 secured to two opposite lateral side plates of the receptacle shell 140. The receptacle shell 140 includes a plurality of spring tangs 147 for abutting against the plug shell 230 during mating. The receptacle shell 140 further forms a pair of mounting legs 146 extending from a front edge thereof in a folded manner. The receptacle shell 140 further includes a locking hole 141 in a top plate 148, in which a locking protrusion 235 of the resilient latch 234 is engaged. In this embodiment, the front mating section 135 of the receptacle contact 134 includes a pair of spring arms 133 commonly sandwiching the corresponding pin type plug contact 220 therebetween in a transverse direction perpendicular to both the vertical direction and the front-to-back direction.

Figure 8:
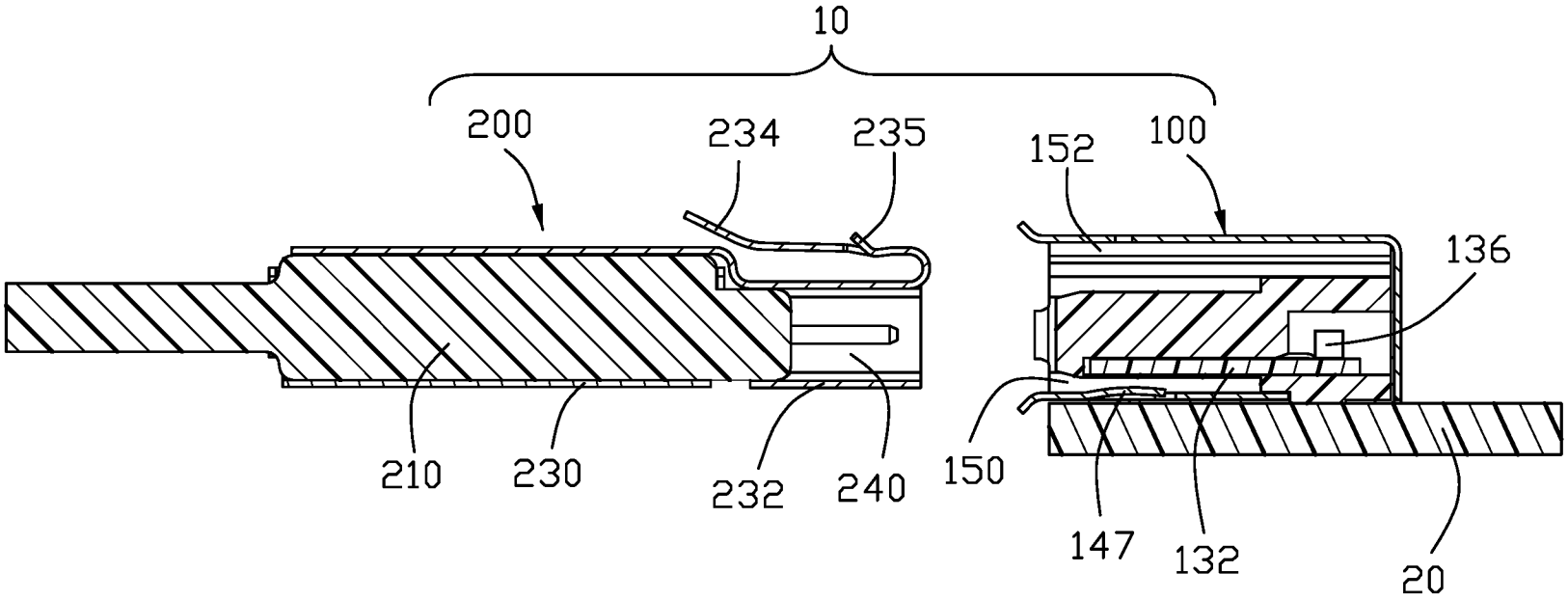
FIG. 8 is a cross-sectional view of the electrical connector assembly of FIG. 1 taken along lines 8-8.
Figure 8A:
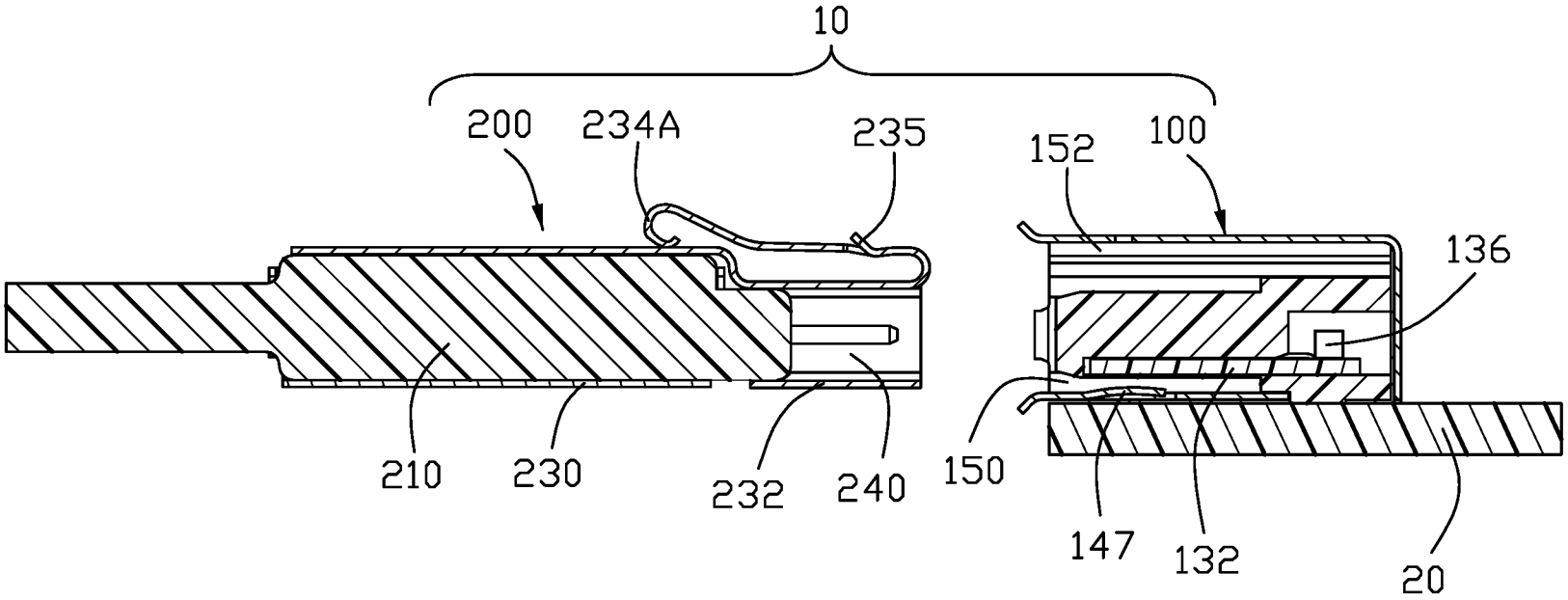
FIG. 8(A) is a cross-sectional view of the electrical connector assembly of another embodiment wherein the free end of the resilient latch constantly abuts against the plug shell.
Figure 8B:
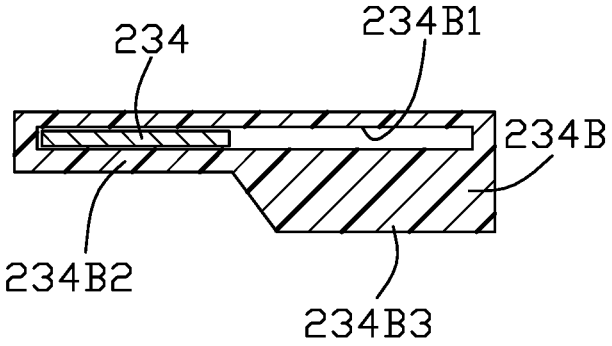
FIG. 8(B) is a cross-sectional view to show another embodiment having a moveable insulative block attached upon the free end of the resilient latch.
Figure 9:
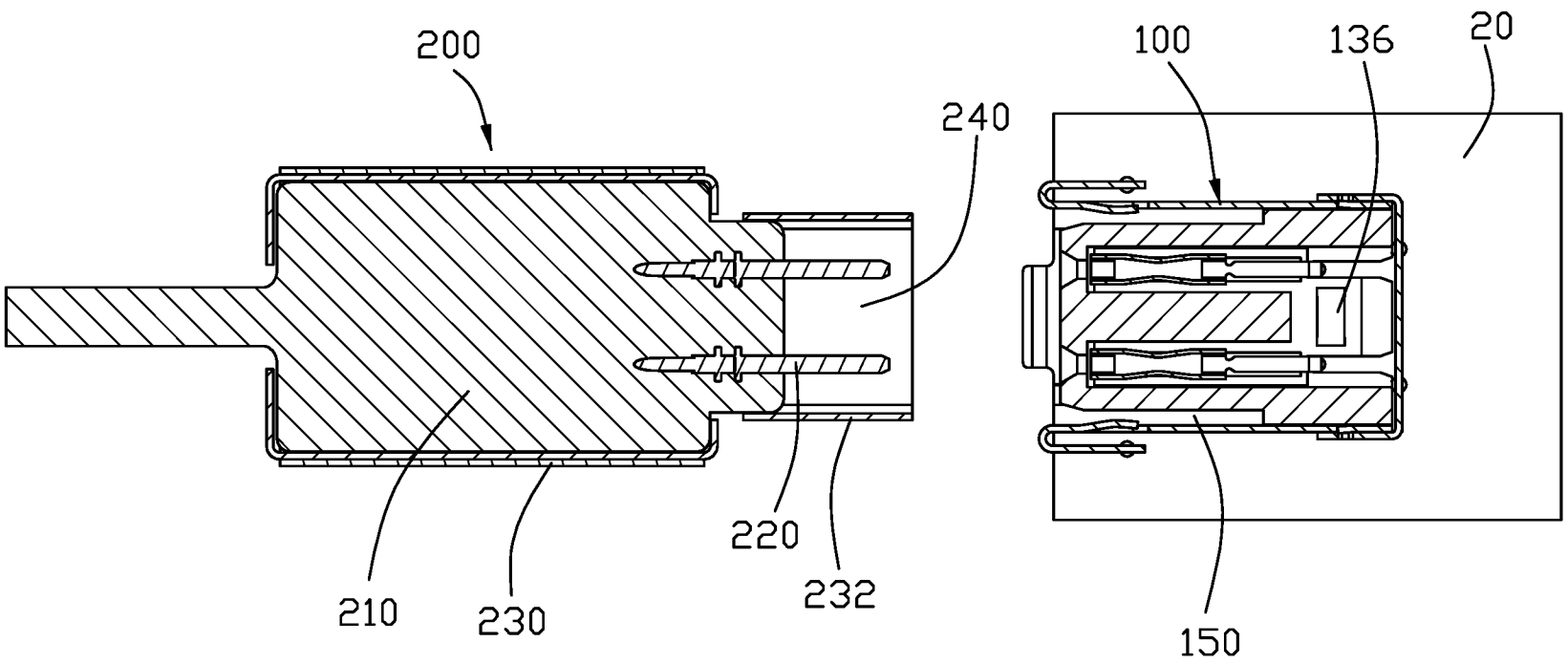
FIG. 9 is a cross-sectional view of the electrical connector assembly of FIG. 1 taken along lines 9-9.
Figure 10:
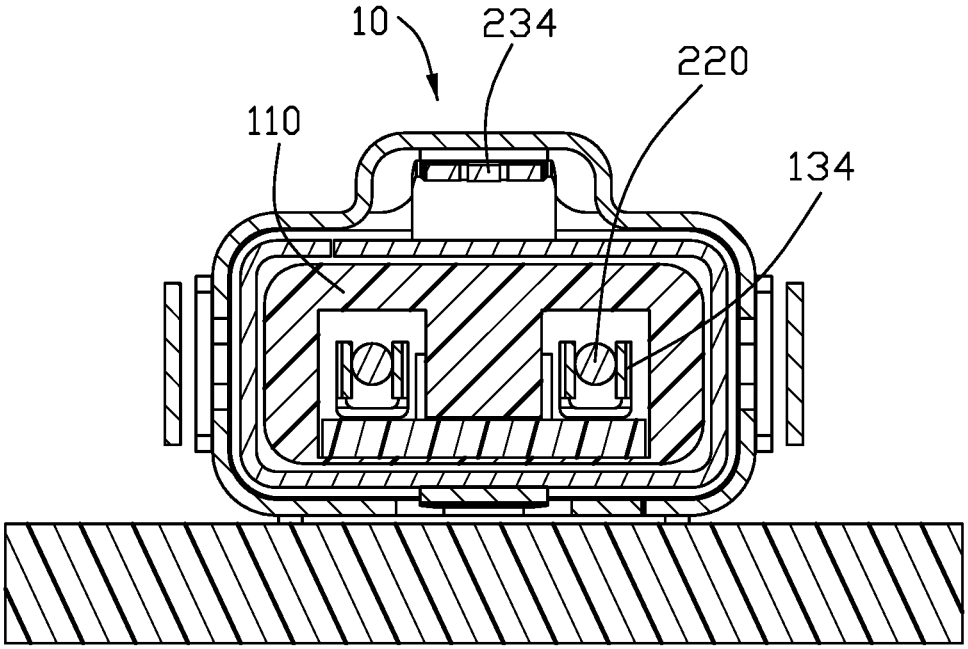
FIG. 10 is a cross-sectional view of the electrical connector assembly of FIG. 3 taken along lines 10-10.

In this embodiment, the resilient latch 234 of the plug connector 200 is cantilevered with a suspended free end. Alternately, as shown in FIG. 8(A), the free end of the resilient latch 234 can be downwardly curved with an extension 234A to abut against the plug shell 230 for avoiding unexpected deflection of the resilient latch 234. In another embodiment, a discrete insulative block 234B has therein a sliding groove 234B1 receiving the free end of the resilient latch 234 so as to allow the block 234B to slide with regard to the resilient latch 234 in the transverse direction between two positions wherein one position having the thin portion 234B2 around, allows downward deflection of the resilient latch 234 while the other position having the thick portion 234B3 around does not. This arrangement also avoids the unexpected deflection of the resilient latch 234. In this embodiment, the receptacle contact unit 130 includes an internal printed circuit board 132 for electrically connecting both the contacts 134 and the common mode choke 136 together. Anyhow, such an internal printed circuit board 132 may be eliminated as long as the common mode choke is electrically connected to the contacts 134 inside the receptacle housing 110. In this embodiment, the front portion 232 of the plug shell 230 is smaller than the rear portion 233 thereof, or the top wall 2321 of the front portion 232 is lower than the top wall 2331 of the rear portion 233, so as to form a recess therebetween to receive the resilient latch 234 therein without interference.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector assembly comprising:

a plug connector and a receptacle connector adapted to be mated with each other;

the plug connector including:

an insulative plug housing;

a plurality of plug contacts retained in the plug housing;

a metallic plug shell enclosing the plug housing to form a receiving cavity in which the plug contacts are exposed;

a resilient latch disposed upon the plug shell;

a cable electrically connected to the contacts and extending outwardly; and the receptacle connector including:

an insulative receptacle housing having a base and a mating tongue forwardly extending therefrom in a front-to-back direction;

a receptacle contact unit retained in the receptacle housing and including a plurality of receptacle contacts and a common mode choke electrically connected with each other;

a metallic receptacle shell enclosing the receptacle housing and forming a circumferential space therebetween with an enlarged locking area thereof;

wherein during mating, the mating tongue is received within the receiving cavity, the plug shell is received within the circumferential space, the plug contacts are respectively mated with the corresponding receptacle contacts, and the resilient latch is received within the enlarged locking area;

wherein the receptacle contact unit includes an internal printed circuit board on which both the receptacle contacts and the common mode choke are soldered; and wherein the mating tongue of the receptacle housing forms a plurality of passageways therein to receive the corresponding receptacle contacts, respectively, and one side of each passageway is formed by said internal printed circuit board.

2. The electrical connector assembly as claimed in claim 1, wherein the resilient latch unitarily extends from a front edge of the plug shell.

3. The electrical connector assembly as claimed in claim 2, wherein said resilient latch is equipped with means for avoiding unexpected deflection.

4. The electrical connector assembly as claimed in claim 1, wherein a recess is formed between a front portion of the plug housing and a rear portion of the plug housing to receive the resilient latch therein.

5. The electrical connector assembly as claimed in claim 1, wherein the base of the receptacle housing forms a plurality of grooves in alignment with the corresponding passageways, respectively, to receive corresponding mounting sections of the receptacle contacts for mounting to an external printed circuit board.

6. The electrical connector assembly as claimed in claim 5, wherein said grooves communicate with exterior rearwardly in a front-to-back direction.

7. The electrical connector assembly as claimed in claim 1, wherein the mating tongue forms a front end face with therein a plurality of mating holes in alignment with the corresponding passageways, respectively, through which the corresponding plug contacts extend.

8. The electrical connector assembly as claimed in claim 1, wherein the base of the receptacle housing forms a space to allow the receptacle contact unit to be assembled into the receptacle housing forwardly in the front-to-back direction from a rear side of the receptacle housing.

9. The electrical connector assembly as claimed in claim 1, wherein the receptacle shell forms a locking hole to receive a protrusion of the resilient latch of the plug connector.

10. A receptacle connector comprising:

an insulative receptacle housing having a base and a mating tongue extending forwardly therefrom in a front-to-back direction;

a receptacle contact unit forwardly assembled within the receptacle housing and having a plurality of receptacle contacts and a common mode choke electrically connected with each other;

a metallic receptacle shell enclosing the receptacle housing and forming a circumferential space therebetween with an enlarged locking area thereof for respectively receiving a metallic plug shell and a resilient latch associated therewith of a plug connector;

wherein the mating tongue of the receptacle housing forms a plurality of passageways therein to receive the corresponding receptacle contacts, respectively; and wherein a front end face of the mating tongue forms a plurality of through holes in alignment with corresponding passageways, respectively, and the through holes are configured to comply with plug contacts of the plug connector and are different from the passageways which are configured to comply with the receptacle contacts.

11. The receptacle connector as claimed in claim 10, wherein the receptacle shell includes four sides of which three sides form spring tangs for engagement with the plug shell and one side forms a locking hole for engagement with a protrusion of the resilient latch of the plug connector.

12. The receptacle connector as claimed in claim 10, wherein the receptacle contact unit includes an internal printed circuit board on which both the receptacle contacts and the common mode choke are soldered.

13. The receptacle connector as claimed in claim 10, wherein the base of the receptacle housing forms a plurality of grooves to receive mounting sections of the corresponding receptacle contacts, respectively, and said grooves communicate with an exterior rearwardly in said front-to-back direction.

* * * * *